United States Patent [19]

Serlin

[11] 3,998,564

[45] Dec. 21, 1976

[54] GROOVE FORMING METHOD FOR CONCRETE ROADWAYS

[76] Inventor: Richard A. Serlin, 10 Barbour Lane, Bloomfield Hills, Mich. 48013

[22] Filed: Sept. 2, 1975

[21] Appl. No.: 609,490

[52] U.S. Cl. ..... 404/89; 428/167

[51] Int. Cl.[2] ..... E01C 23/02

[58] Field of Search ..... 404/83, 87, 89, 93; 15/235.3; 428/167

[56] References Cited

UNITED STATES PATENTS

| | | | |
|---|---|---|---|
| 3,126,978 | 3/1964 | Bergstrom | 428/167 |
| 3,401,610 | 9/1968 | Hanson | 428/167 |
| 3,748,214 | 7/1973 | Withers | 428/167 |
| 3,832,267 | 8/1974 | Liu | 428/167 |
| 3,910,711 | 10/1975 | Moorhead | 404/89 |

*Primary Examiner*—Henry S. Jaudon
*Attorney, Agent, or Firm*—Harness, Dickey & Pierce

[57] ABSTRACT

Method and apparatus for forming grooves or slots in a concrete roadway are disclosed. A ribbed sheet of flexible material is positioned on the surface of a freshly poured concrete roadway and the ribs are impressed into the concrete. After the concrete has set and the sheet is removed, a plurality of parallel, skid-resistant grooves are revealed in the roadway. The flexible sheet is placed on and later removed from the roadway by rolling and unrolling it from a spool mounted on a construction vehicle. In one embodiment of the invention, a plurality of small holes are provided in the flexible sheet to aid in the drying of the concrete.

5 Claims, 3 Drawing Figures

Fig. 1.
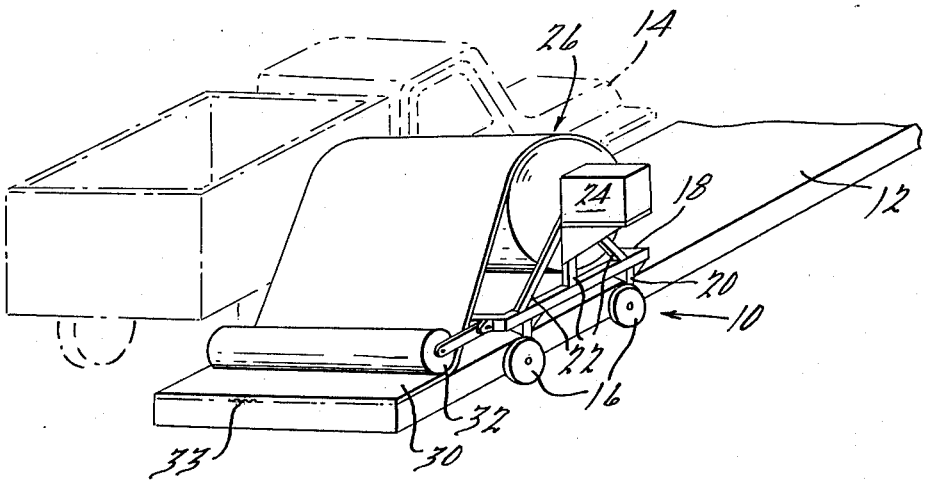
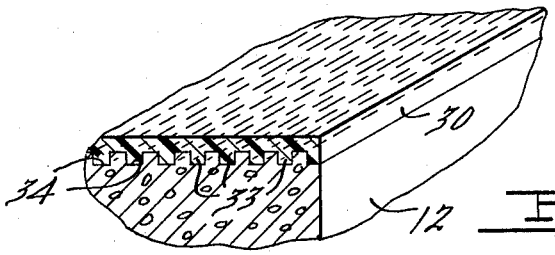
Fig. 2.
Fig. 3.
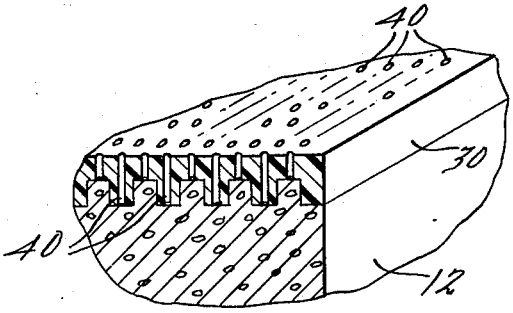

GROOVE FORMING METHOD FOR CONCRETE ROADWAYS

BACKGROUND — SUMMARY OF THE INVENTION

The present invention relates to an apparatus and method for forming grooves or slots in concrete roadways and airport runway pavements. High-speed travel on smooth, slick concrete roadways is often hazardous when the roadways are wet. Water lays upon the roadway in a surface film and the tires of a vehicle or airplane tend to skim along the surface of the water thereby reducing friction against the road. This effect is commonly known as hydroplaning. The effect of braking and skid control are substantially reduced, if not eliminated, during hydroplaning.

To eliminate or substantially reduce hydroplaning and loss of control, it is imperative to reduce the amount of water standing on the surface of the roadways. One method which has been effective in this regard is to provide a plurality of parallel, closely-spaced grooves or slots in the concrete pavement, the grooves running either longitudinally or transversely to the direction of travel. The grooves provide escape routes from the upper surface of the roadway for the water, thereby leaving less water on the upper road surface for the tires to contact.

The usual method of providing the slots or grooves is by cutting them in the finished roadway with diamond tipped cutters. The concrete is allowed to harden and the grooves are then cut to the desired depth (about one-eighth to one-fourth of an inch). Electronic sensors and feeler gauges are used to automatically guide the cutting machines and readjust the blades to the required depth. Forming slots or grooves in concrete with this method is slow and expensive and requires cumbersome, complicated and expensive machinery. Also, it is often not possible to slot the entire width of a roadway at one time, thus necessitating numerous passes in the same lane with the grooving machine. Additionally, the cutting often produces cracks or ruptures in the concrete surface causing the roadway to subsequently deteriorate and fracture. Moreover, due to the expense involved and the disruption of traffic in order to cut the grooves, the grooves on highways often are placed only at the most dangerous portions of a roadway, such as on sharp curves. The dangerous skidding conditions thus are allowed to remain on the remainder of the roadway.

It has also been attempted to provide the necessary grooves in the concrete surfaces prior to the final setting of the roadway. For example, in U.S. Pat. Nos. 3,516,339 and 3,703,857, different apparatus are disclosed which form grooves or slots in a concrete roadway by drawing over freshly-laid concrete a plurality of molding bars or flexible rods spaced closely together. It is doubtful, however, whether the apparatus and methods shown in these two patents would achieve uniform and consistent results throughout the length of the concrete roadway due to the various textures and stages of setting of the concrete at various points in the roadway. Moreover, since the concrete has to be sufficiently flowable or liquid at the time of the formation of the grooves to allow the grooves to be formed therein, it is also sufficiently flowable to allow some of the concrete to return into the formed grooves after the grooving rods have passed and to round off the edges of the grooves. This creates a less effective surface for reducing or eliminating skidding conditions. A similar grooving and brooming process is disclosed in U.S. Pat. No. 3,605,579.

An object of the present invention is to provide an improved method and apparatus for forming grooves or slots in concrete roadways. Another object of the present invention is to provide grooves or slots in concrete roadways which are precisely and accurately shaped and thus provide better and more efficient grooves for reducing and eliminating skidding conditions.

In accordance with the present invention, the present apparatus and method provide a sheet of flexible material, such as a fiber-reinforced plastic or elastomer, with a plurality of parallel, closely-spaced ribs on one surface thereof. The ribs are provided either longitudinally or transversely on the sheet. The sheet is positioned on the surface of a freshly poured concrete roadway and the ribs thereon are impressed into the surface. The flexible sheet is placed on the concrete by unrolling it from a spool mounted on a construction vehicle. The sheet is allowed to remain on the roadway until the concrete is set and dry. It is then removed by rolling it back onto the spool revealing the grooves. If desired, holes can be provided in the sheet to hasten the drying of the concrete.

Other objects, features and aspects of the invention will become apparent from the following description and claims when viewed in accordance with the accompanying drawings.

BRIEF DESCRIPTION OF THE DRAWINGS

FIG. 1 is a schematic perspective view of an apparatus in accordance with the present invention attached to a vehicle for carrying, placing, impressing, and retrieving the flexible sheet;

FIG. 2 is a partial cross-sectional view of a concrete roadway showing the use of the present invention; and FIG. 3 is a partial cross-sectional view of a concrete roadway illustrating another embodiment of the present invention.

DESCRIPTION OF THE PREFERRED EMBODIMENTS

Referring to FIG. 1, the method and apparatus for forming grooves or slots in a concrete roadway are disclosed. The groove forming apparatus is indicated generally by the numeral 10. The apparatus 10 is preferably transported and carried beside a freshly-laid concrete roadway strip 12 by a truck or other vehicle 14. The apparatus 10 can be connected to the vehicle 14 in any conventional manner, such as by being attached to the side thereof (as shown in FIG. 1). It is also possible, however, for the apparatus 10 to be placed immediately preceding or behind a vehicle 14 straddling the roadway 12. It is also possible to have the apparatus 10 be motorized and self-contained. The apparatus in this regard would be similar to a concrete spreading apparatus commonly used in constructing roadways. In this regard, the apparatus is sufficiently wide to transverse the width of the freshly laid concrete roadway and rides on appropriate wheels (indicated by numeral 16 in FIG. 1) along the sides of the roadway or on appropriate rails or tracks positioned on each side of the roadway.

As shown in FIG. 1, the apparatus 10 has a platform 18 connected by support means 20 and axles (not shown) to wheels 16 which roll beside the roadway 12.

It is understood that it is possible to have another set of wheels 16 on the opposite side of the roadway (which are not shown in FIG. 1 due to the perspective view thereof). Attached to the base member 18 of the vehicle 10 are support structures 22 which support a motor 24 used for rolling and unrolling the spool of flexible sheeting used to form the appropriate grooves or slots in the roadway 12. The roll or spool is indicated generally by the numeral 26 and the flexible sheet unwound from the roll 26 is indicated by the numeral 30.

The sheet 30 is positioned on the top of the newly poured concrete roadway 12 and unrolled from the roll 26 as the apparatus 10 is moved along the length of the roadway 12 by the vehicle 14 or other appropriate means as described above. The motor 24 assists in unrolling the roll 26, although it is understood that the roll could be operated mechanically by any conventional means. One or more rollers 32 are attached to the apparatus 10 and positioned so that they smooth the sheet 30 on the surface of the concrete and also impress the ribs thereon into the concrete. The roll 32 is weighted or fixedly secured to the apparatus 10 to allow it to function in this manner.

The sheet 30 can be of any appropriate material, so long as it is sufficiently flexible to be rolled and unrolled, sufficiently durable to be repeatedly reused without deteriorating, and sufficiently strong to allow the longitudinal ribs 33 to be precisely and accurately formed and maintained therein. In this regard, the sheet 30 can be of a flexible material such as fiber-reinforced plastic or an elastomer.

As shown in FIG. 2, the flexible sheet 30 has a plurality of closely spaced and parallel ribs 33 on the underside thereof. The ribs 33 are positioned either longitudinally or transversely to the length of the sheet 30. The ribs 33 can be of any appropriate height and distance apart in order to form the desired depth and number of grooves 34 across the width or length of the roadway as required. For example, it is common to provide ⅛ to ¼ inch deep slots or grooves in roadways on approximately ¾ inch centers.

In accordance with the present inventon, the flexible ribbed sheet 30 is placed on and pressed into the surface of the newly poured concrete 12. When the concrete roadway 12 is of the desired consistency, the apparatus 10 is moved along the lane or roadway 12 and the flexible ribbed sheet 30 is unrolled and positioned on the upper surface thereof. The roller members 32 are pressed along the upper surface of the sheet 30 and embed and impress the ribs 33 into the surface of the roadway 12. The sheet 30 is then allowed to remain on the surface of the roadway 12 until the concrete has set or hardened. Thereafter, the apparatus 10, attached to the vehicle 14 or other appropriate transport means, is moved again along the length of the roadway for retrieval of the sheet 30. The sheet 30 is threaded under the roller members 32 and onto the axle or spool attached to the motor 24 and the sheet is then wound into a roll 26 as it is picked up.

The present apparatus and method provide an improved concrete roadway which eliminates or at least substantially reduces skidding conditions. The grooves or slots 34 formed in the roadway have well-defined hill, valley and wall surfaces, as well as well-defined angles between these surfaces creating a more efficient and more satisfactorily grooved surface for vehicle travel.

Another embodiment of the invention is shown in FIG. 3. In this embodiment, the ribbed flexible sheet 30 is provided with a plurality of small holes 40. The holes 40 are positioned in either the hills or valleys of the ribbed sheet 30, or along both the hills and valleys. The holes 40 provide for escape of any excess water remaining or formed on the surface of the roadway 12, and also provide for circulation of air on the top of the roadway 12 to assist and hasten the drying process. If any concrete is forced up into the holes 40 when the flexible sheet 30 is impressed on the roadway 12, the resultant small posts or rods formed on the surface will be easily broken off when the sheet 30 is retrieved or removed, without damage to the surface of the roadway 12. The holes 40 should be small in diameter so that an insufficient amount of concrete can be forced into them. In this regard, the holes should be in the order of ⅛ inch in diameter. Also, the holes 40 are spaced on the order of 1 to 6 inches apart along the length of the flexible sheet 30 in order to allow sufficient air circulation and water escape routes.

It is to be understood that the foregoing description describes preferred embodiments of the invention. Various changes and modifications may be made without departing from the spirit and scope of the invention as defined by the appended claims.

I claim:

1. A method for forming grooves in freshly-poured concrete roadways, said method comprising the steps of positioning a sheet of flexible material on said freshly-poured concrete roadway, said sheet having a plurality of parallel, closely-spaced ribs on the side facing said roadway, impressing said sheet onto said surface of said roadway in order to embed said ribs into said freshly-poured concrete and form said grooves, allowing the concrete roadway to set, and removing said sheet from said roadway after the concrete has set whereby permanently formed and precisely defined grooves are revealed.

2. The invention as defined in claim 1 wherein a plurality of openings are provided extending through said sheet in order to assist in the setting and drying of said concrete.

3. The invention as defined in claim 1 wherein said ribs are positioned longitudinally on said sheet.

4. The invention as defined in claim 1 wherein said ribs are positioned transversely on said sheet.

5. The invention as defined in claim 1 wherein said concrete roadway is allowed to dry before removing said sheet from said roadway.

* * * * *